US008092405B2

(12) United States Patent
Klearman

(10) Patent No.: US 8,092,405 B2
(45) Date of Patent: Jan. 10, 2012

(54) SELF CONTAINED ORAL VIBRATOR WITH ELASTOMERIC BAND

(76) Inventor: Jeffrey Dean Klearman, St. Louis, MO (US)

( * ) Notice: Subject to any disclaimer, the term of this patent is extended or adjusted under 35 U.S.C. 154(b) by 1148 days.

(21) Appl. No.: 11/856,772

(22) Filed: Sep. 18, 2007

(65) Prior Publication Data

US 2008/0077058 A1 Mar. 27, 2008

Related U.S. Application Data

(60) Provisional application No. 60/846,842, filed on Sep. 25, 2006.

(51) Int. Cl.
*A61H 1/00* (2006.01)

(52) U.S. Cl. ..... 601/70; 601/46; 601/48

(58) Field of Classification Search ..... 601/46, 601/48, 70, 72, 74, 78, 79, 80, 81; 600/38; 128/844

See application file for complete search history.

(56) References Cited

U.S. PATENT DOCUMENTS 4,075,970 A * 2/1978 Blake et al. ..... 440/6
6,028,531 A * 2/2000 Wanderlich ..... 340/7.6
7,108,668 B2 * 9/2006 Fang ..... 601/70
2003/0083598 A1 * 5/2003 Kobayashi et al. ..... 601/70
2003/0142512 A1 * 7/2003 Klearman et al. ..... 362/571
2003/0181835 A1 * 9/2003 Klein ..... 601/72
2005/0081863 A1 * 4/2005 Lin ..... 128/844
2005/0283044 A1 * 12/2005 Chang ..... 600/38
2006/0247493 A1 * 11/2006 Chen ..... 600/38
2007/0038019 A1 * 2/2007 Weng ..... 600/38
2009/0306468 A1 * 12/2009 Tasker et al. ..... 600/41
2010/0010292 A1 * 1/2010 Talbot et al. ..... 600/38

* cited by examiner

*Primary Examiner* — Justine Yu
*Assistant Examiner* — Colin W Stuart
(74) *Attorney, Agent, or Firm* — White-Welker & Welker, LLC; Matthew T. Welker, Esq.

(57) ABSTRACT

A self-contained oral vibrator featuring an elastomeric band that is generally used as a sexual novelty apparatus. The apparatus is made of two basic parts. The first part, the integrated vibrator, is comprised of a motor used to cause vibration, a small battery power source and an external barrel 4. The second primary element of the apparatus is the elastomeric band itself. The band is designed to both fasten to the tongue during use and also house the vibration apparatus. The elastomeric band is essentially made of two parts; the first part, the bottom part, is a flat loop that wraps around the tongue during use while the second part, the top part, is designed as a barrel 4 to hold in place the vibration barrel in place. The vibration barrel and band together form an integrated tongue vibrator absent the necessity for multiple parts to achieve the same end result.

4 Claims, 17 Drawing Sheets

SELF CONTAINED ORAL VIBRATOR WITH ELASTOMERIC BAND

CROSS REFERENCE TO RELATED APPLICATIONS:

This application claims priority from U.S. Provisional Patent Application Ser. No. 60/846,842, entitled "Self Contained Oral Vibrator With Elastomeric Band", filed on Sep. 25, 2006.

TECHNICAL FIELD OF THE INVENTION

The present invention relates generally to tongue vibrators. More specifically, the present invention relates to an oral vibrator which can be worn by either men or women without regard to a tongue piercing that creates a sexual novelty and does not look like or function like traditional tongue jewelry.

BACKGROUND OF THE INVENTION

Tongue vibrators are sold in sexual novelty stores throughout the United States and beyond. In many instances, tongue vibrators require permanent piercing and the apparatus consists of a top portion with an integrated vibrator and a bottom portion that is attached to the underside of the tongue. In other instances, the tongue vibrator is an adaptation of the piercing version which further makes use of a silicon band with a hole that wraps around the tongue and the tongue vibrator jewelry is attached through the hole in the band with the top, vibrator portion now on the tip of the tongue and the bottom portion which generally attaches under the tongue now connected at the base of the tongue on the other side of the hole in the silicon band.

In all cases, the tongue vibrator is very similar to a standard tongue ring consisting of a vibrator encased generally in the ring's barbell, an elongated stem used to connect the ring's vibrator to the power source which is essentially an adaptation of a traditional tongue vibrator stem. In some cases, a small power source is housed at the top near the vibrator rather than at the bottom although the power source in these instances is generally supplemented with an external, wired power source frequently known as a turbo charger. These apparatus collectively are very similar to traditional tongue jewelry and tongue rings and are fairly expensive retailing for roughly fifty dollars and more.

The objects and potential uses of the present invention will become readily apparent upon further review of the following description, and various other features and attendant advantages will become more fully appreciated as the invention becomes better understood when considered in conjunction with the accompanying drawings, in which like reference characters designate the same or similar parts throughout the several views.

SUMMARY OF THE INVENTION

The invention discussed herein is not intended at all to perform or substitute for a traditional tongue ring; it is designed solely as a sexual novelty and does not look like or function like tongue jewelry. It is an inexpensive oral vibrator, which can be worn by either men or women without regard to a tongue piercing whatsoever.

The apparatus is essentially an elastomeric band made of two barrels. The first part of the band is essentially a barrel which holds in place a vibration apparatus while the second element of the band wraps around the tongue to hold in place while in use. Inside the barrel is a vibration apparatus consisting of a small vibrator motor, a power source, switching mechanisms and an exterior plastic or like barrel. This sexual novelty apparatus comes in two forms, a reusable version and a disposable version. The reusable version features a latch door for battery interchange and may feature more than one battery cell for enhanced vibration output based upon making use of power of the additional cells to drive the vibrator motor at greater revolutions per minute.

Through the use of an integrated switch, the apparatus in the two cell form will either use the power of one or two battery cells and at one battery cell the motor will spin at 11,000 RPM while when two cells are activated the apparatus will spin at 16,000 RPM. The latch door is so that the small batteries, which have generally a very short life and can be exchanged for recurrent use. The latch door and the integrated switch permit the apparatus to work at two different speeds. The other form of the integrated tongue ring is a disposable version which does not offer the latch door for battery interchange and will only last as long as the useful life of the batteries. In either form, the apparatus is an inexpensive, adult novelty that makes use of vibration as a sexual enhancement in the context of oral sex.

In an alternative embodiment, the apparatus can be made in a disposable form omitting the latch door and not offering the consumer the ability for battery interchange. In those cases the apparatus will only last as long as the useful life of the batteries place inside the vibration barrel at the time of manufacture.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
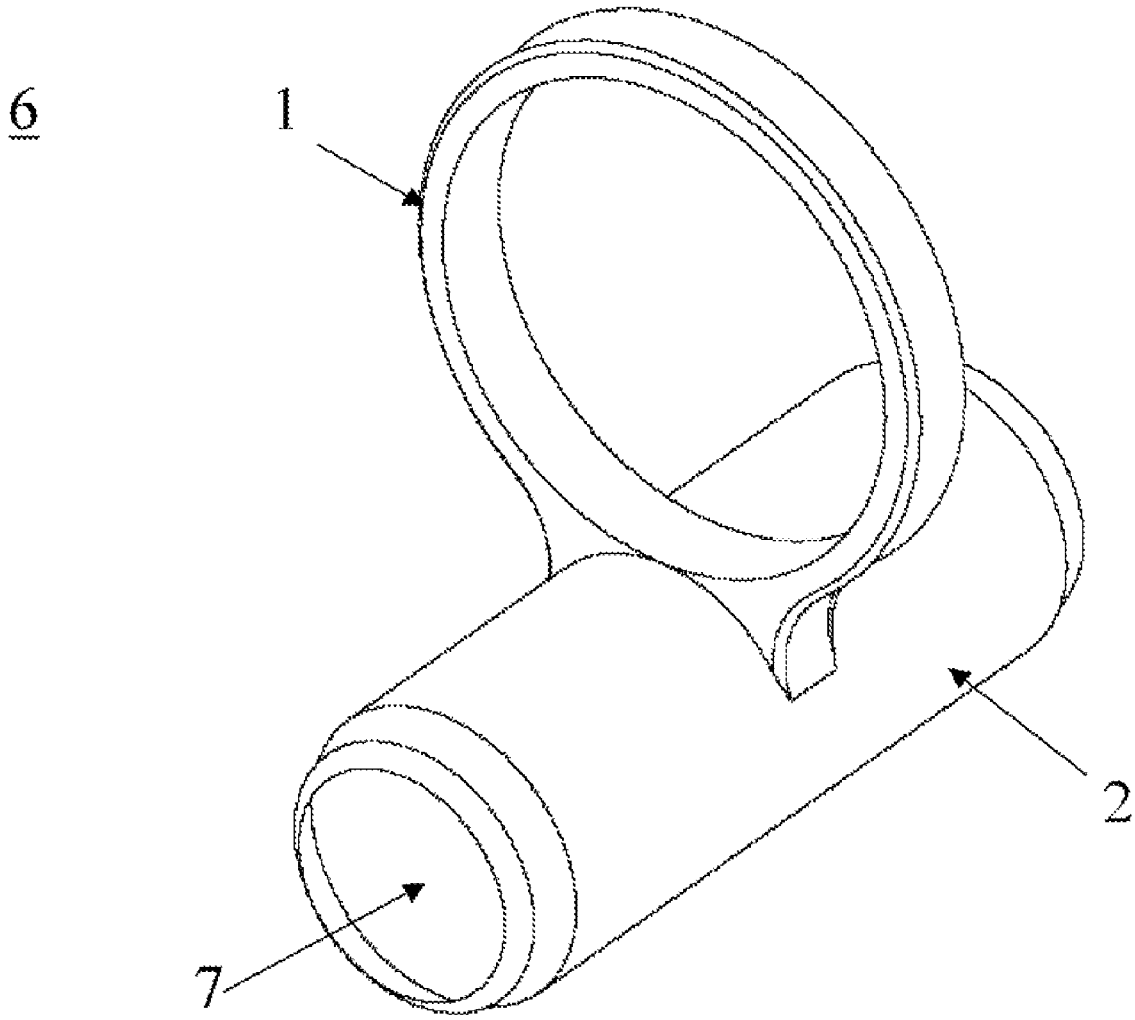
FIG. 1 is a perspective view of the self-contained oral vibrator with elastomeric band apparatus of the present invention.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

Referring to the figures, it is possible to see the various major elements constituting the apparatus of the present invention. The present invention is a self contained oral vibrator with elastomeric band which can be worn by either men or women without regard to a tongue piercing that creates a sexual novelty and does not look like or function like traditional tongue jewelry.

A self-contained oral vibrator featuring a unique elastomeric ring 1 is provided which will generally be used as a sexual novelty apparatus. The apparatus, which is ultimately integrated during the manufacturing process, is made in two basic parts. The first part, the vibration barrel 4 made of plastic, metal or other materials further comprised of a pager or like motor 12 used to cause vibration, a small battery power source generally hearing aid batteries 10 and 11.

It is of benefit to make the integrated vibrator generally as small as possible to the extent the rate of vibration is not particularly compromised. In one embodiment of the product, the batteries 10 and 11 are permanent fixtures and therefore the product is designed for a single use. In another embodiment, the barrel 4 has a battery-latched door 5 that permits the exchange of batteries and therefore can be used for a protracted period of time based on renewing the power source.

The second primary element of the self-contained oral vibrator with elastomeric band 6 is the flat loop 1. The elastomeric band 6 is designed to both fasten to the tongue during use and also house the vibration apparatus in such a way so as to maximize the product's intended benefit. The elastomeric band 6 is made of a very pliable elastomeric material that has both considerable stretch properties to it as well as a fair degree of memory. The elastomeric band 6 is essentially made of two parts; the first part, the bottom part, is a flat loop 1 that wraps around the tongue during use while the second part, the top part, is designed as a barrel or motor case 2 to hold the vibration barrel 4 in place.

In the preferred embodiment, the bottom portion also know as the motor case 2 and the flat loop 1 are affixed to each other at one hundred and eighty degrees and in effect form a series of four right angles. Because of the way the flat loop 1 and motor case 2 portions are affixed to one another, the apparatus is able to achieve the maximum degree of vibration when in use further asserting that the pager or like motor in closest to the tip of the tongue during use. The vibration barrel 4 and band elastomeric 6 together form an integrated tongue vibrator absent the necessity for multiple parts to achieve the same end result. It should be further noted that in some cases the vibration barrel 4 has an exterior switch 3 that can further regulate the rate of vibration from slower to faster based upon the pager or like motors 12 revolutions per minute; an external switch 3 is also used to engage the apparatus itself in terms of turning it on and off. The elastomeric band 6 may contain one or more openings 7 to accommodate the various switching mechanisms 3.

It should be further noted that the term fully integrated tongue vibrator refers to a one piece tongue vibrator apparatus consisting of an interior vibration barrel 4 apparatus or motor case 2 consisting of a vibrator motor 12, power source 10 and 11, switching mechanisms 3 and a vibration barrel 4 affixed inside the vibrator barrel case 2 of an elastomeric band 6 whereby the elastomeric band 6 consists of the vibrator barrel case 2 to hold the vibration barrel 4 and a bottom portion or outer sleeve ring 1 of the elastomeric band 6 which is designed to wrap around the tongue when the complete apparatus is in use.

The figures represent the preferred embodiment of the present invention. The apparatus consists of a vibrator barrel 4 consisting of a small vibrator or pager motor 12, a power source consisting of a first battery 10 and a second battery 11, switching mechanisms 3 which can both turn on and off the apparatus as well as determine the rate at which the vibrator spins, and a vibration barrel 4 consisting of a first case half 8 and a second case half 9. The vibration barrel 4 is then placed inside the vibrator barrel case 2 of the elastomeric ring 1 and is held in place while the outer sleeve ring 1 of the elastomeric band 6 is used to wrap around the tongue while in use.

In the preferred embodiment, the vibrator barrel case 2 of the elastomeric ring 1 is placed at a one hundred and eighty degree angle from the bottom or underside of the elastomeric ring 1 so that the vibrator can be positioned at the tip of the tongue for maximum vibration strength.

Also, in the preferred embodiment, the outer sleeve ring 1 is made of a very pliable plastic material that has the stretch to wrap around the tongue while at the same time has the memory to be used both recurrently and hold securely in place the vibrator barrel 4. In any alternative iteration of the preferred embodiment, the apparatus is intended for the specific purpose of serving as a sexual enhancement in the context of adding vibration to oral sex and is not intended to look like or serve in any way like traditional tongue jewelry.

Figure 2A:
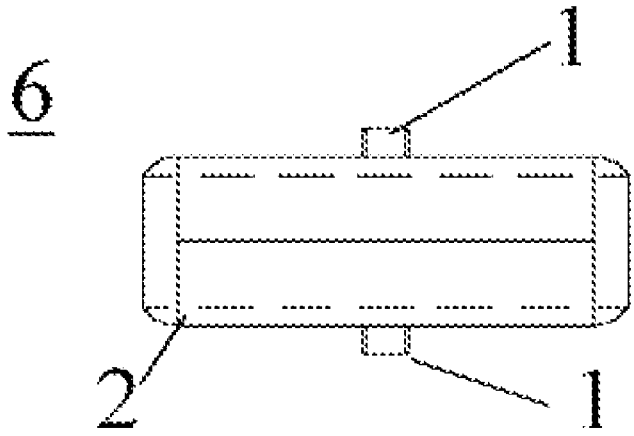
FIGS. 2*a*, 2*b*, and 2*c* are isomeric side, top, and bottom views of the vibrator barrel case and outer sleeve ring of the apparatus of the present invention.
Figure 2B:
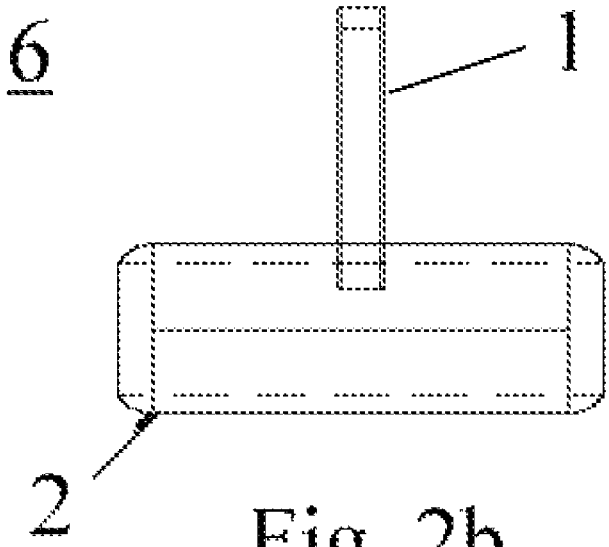
Figure 2C:
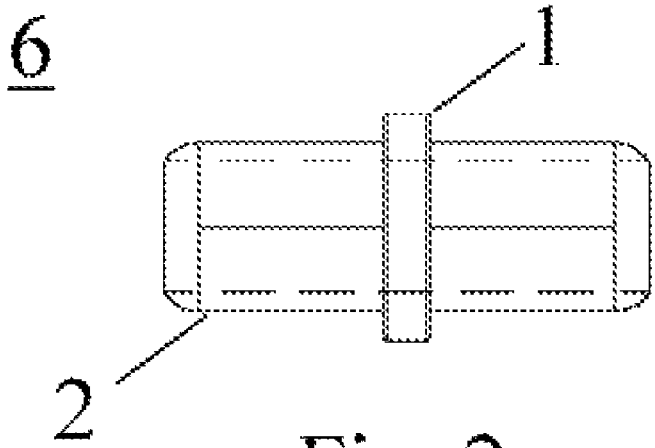
Figure 3:
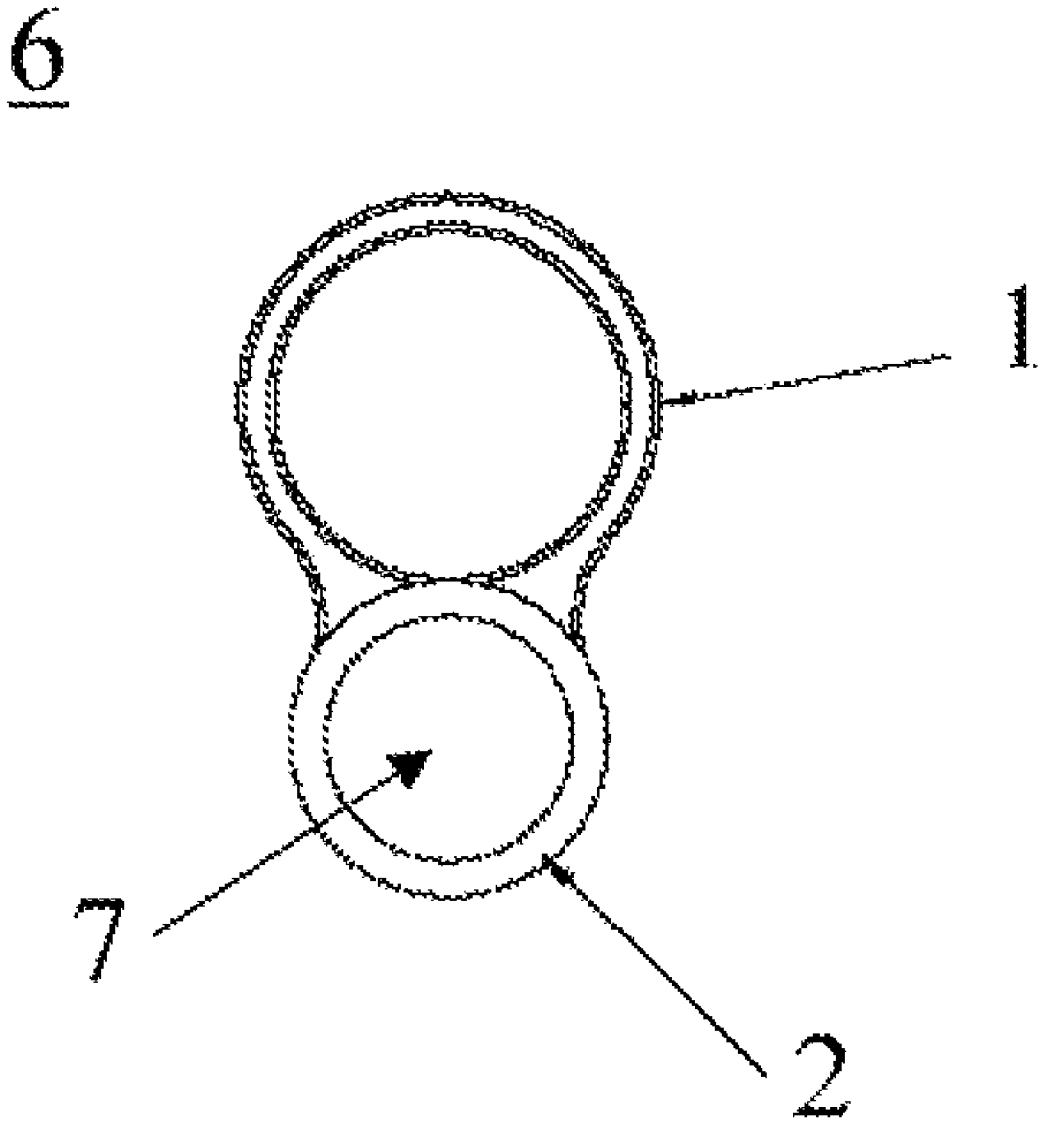
FIG. 3 is an isomeric front view of the vibrator barrel case and outer sleeve ring of the apparatus of the present invention.
Figure 4:
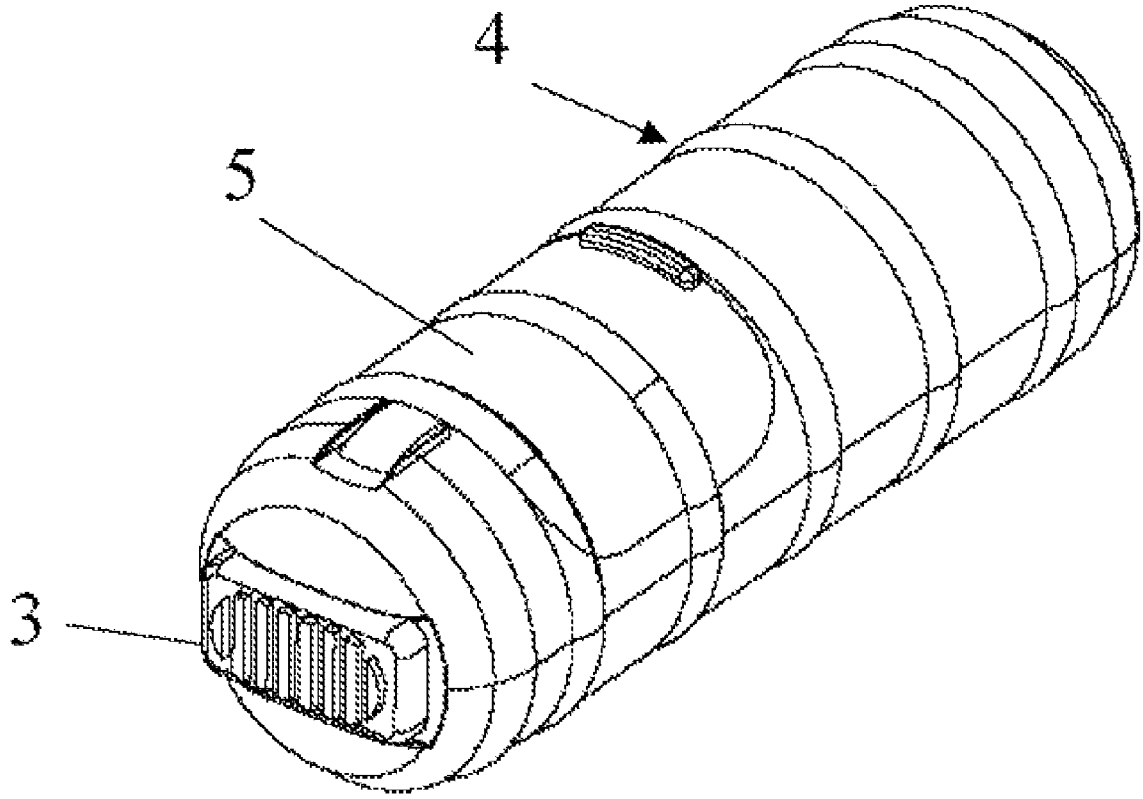
FIG. 4 is perspective view of the vibrator barrel illustrating the on/off speed switch and battery latch door of the apparatus of the present invention.
Figure 5:
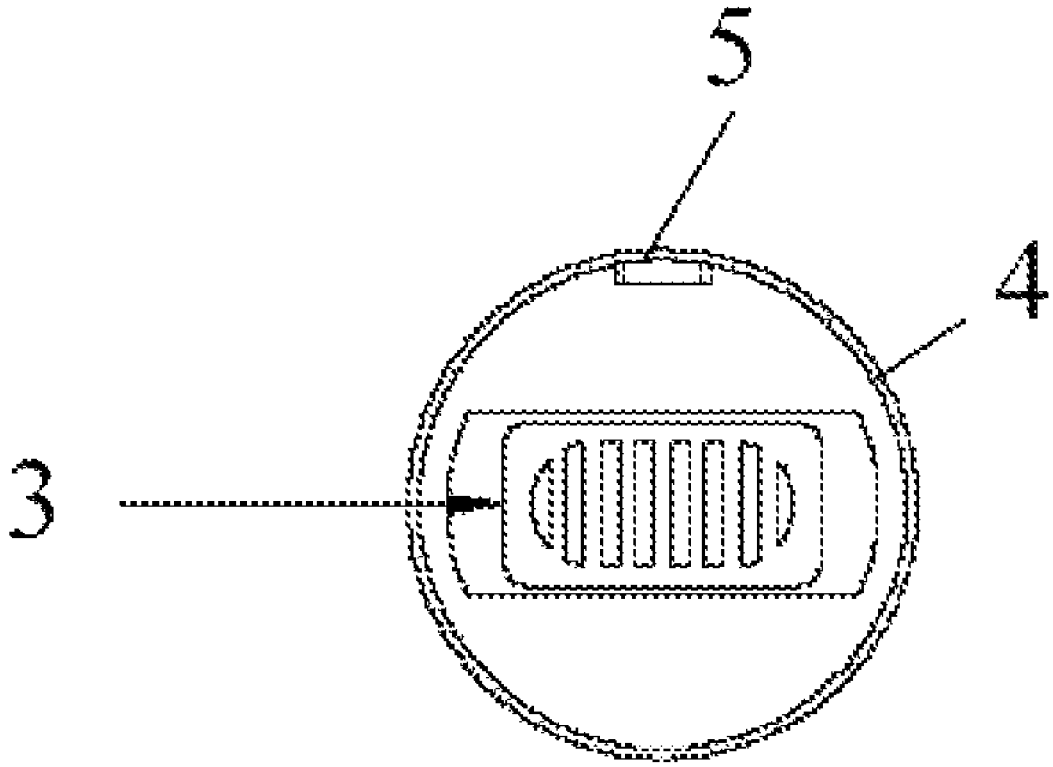
FIG. 5 is an isomeric front view of the vibrator barrel illustrating the on/off speed switch of the apparatus of the present invention.
Figure 6:
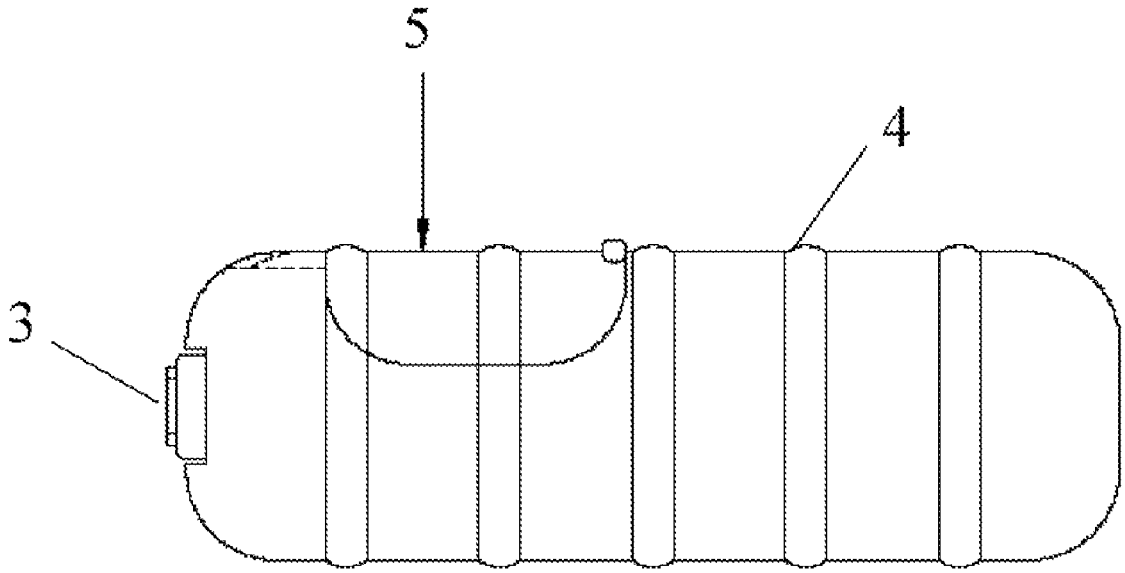
FIG. 6 is an isomeric side view of the vibrator barrel illustrating the on/off speed switch and battery latch door of the apparatus of the present invention.
Figure 7:
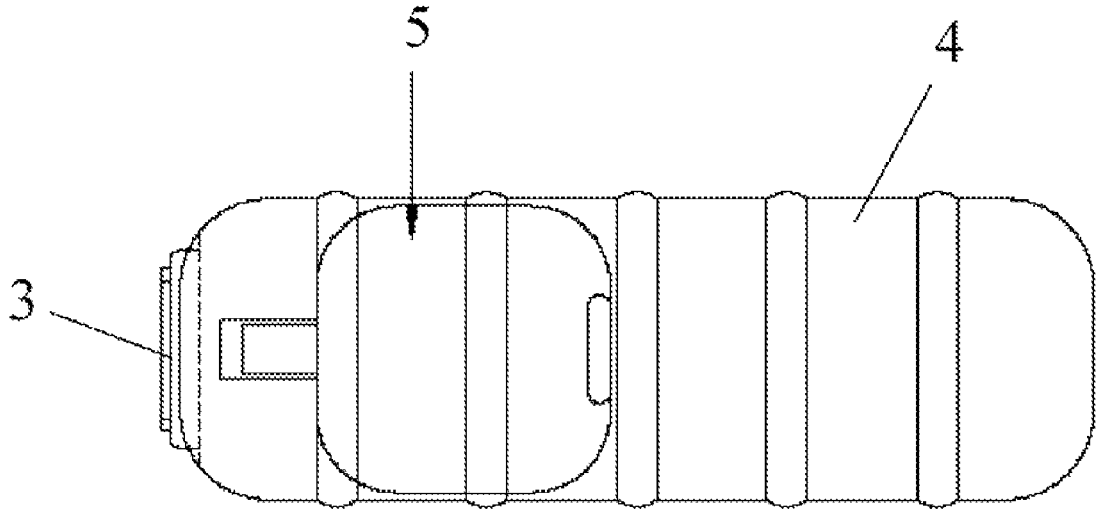
FIG. 7 is an isomeric top view of the vibrator barrel illustrating the on/off speed switch and battery latch door of the apparatus of the present invention.
Figure 8:
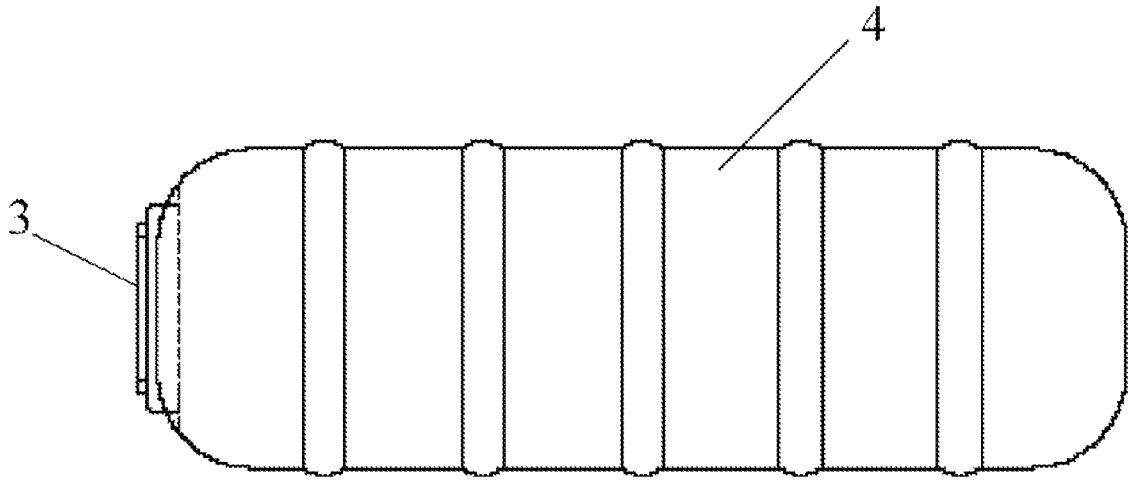
FIG. 8 is an isomeric side view of the vibrator barrel of the apparatus of the present invention.
Figure 9:
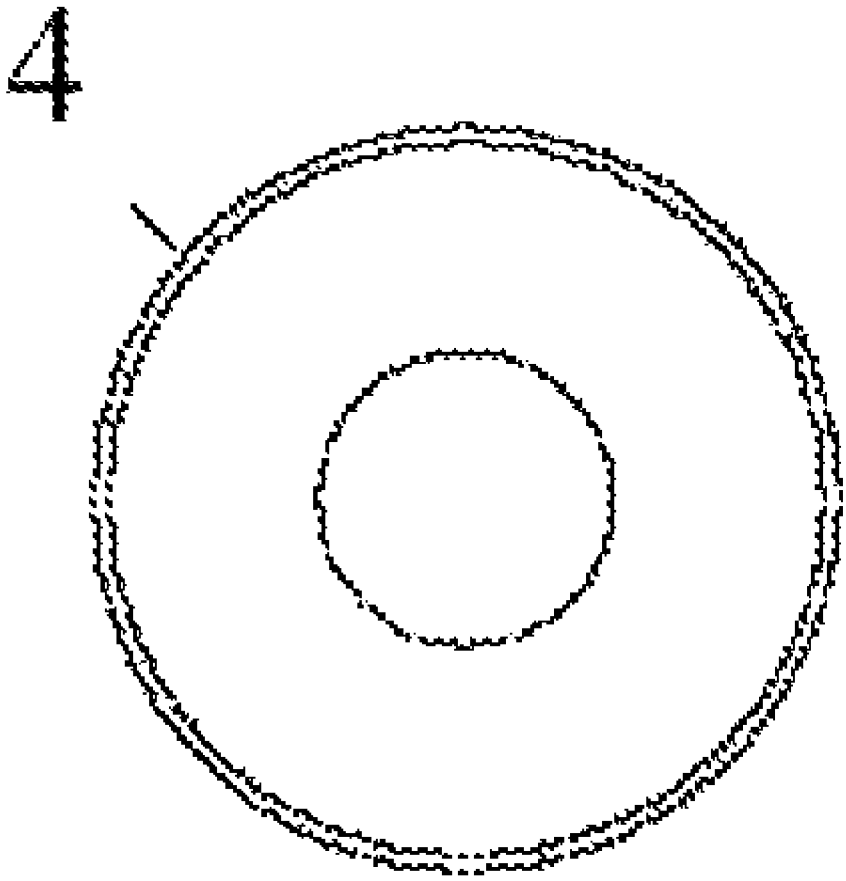
FIG. 9 is an isomeric back view of the vibrator barrel of the apparatus of the present invention.
Figure 10:
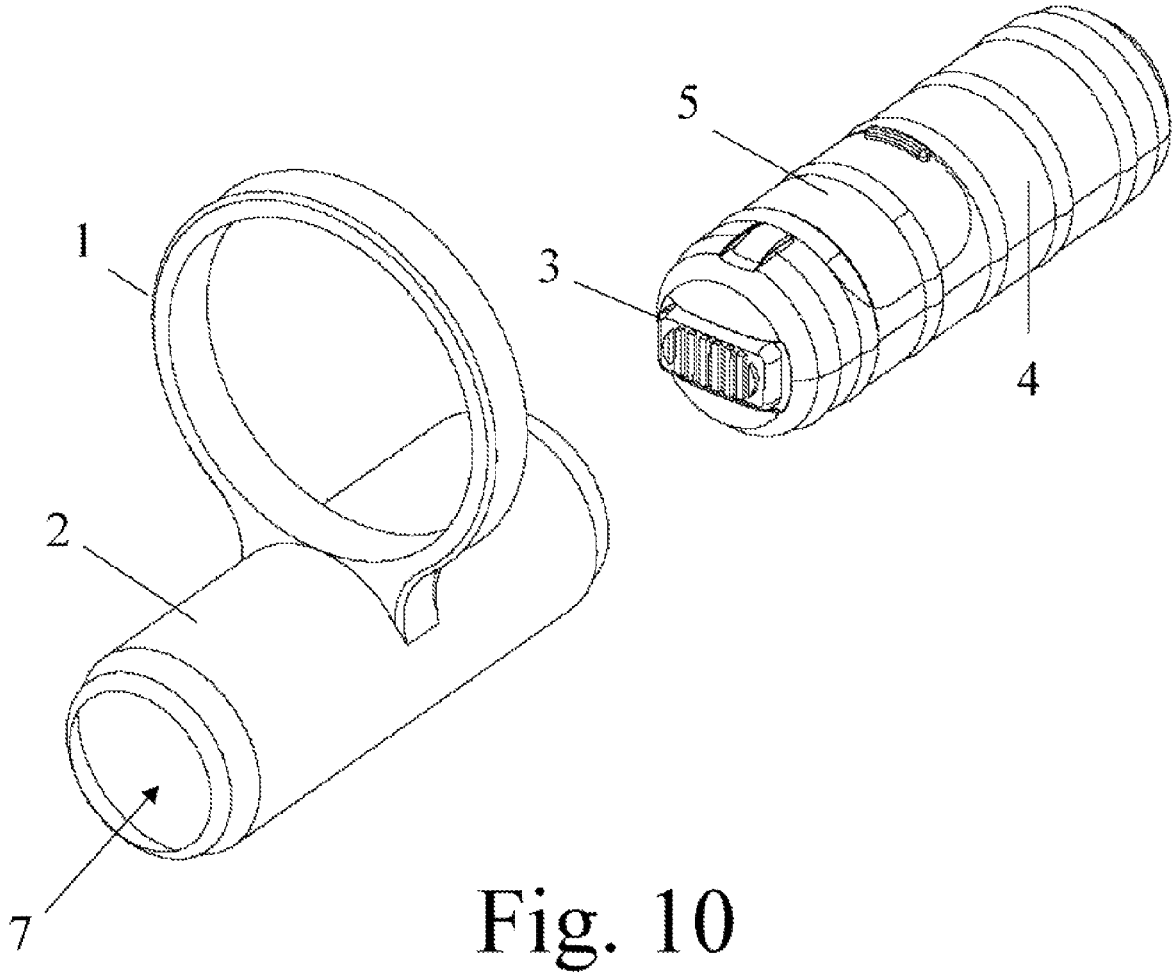
FIG. 10 is perspective-expanded view of the vibration barrel that is inserted into the sleeve of the apparatus of the present invention.
Figure 11:
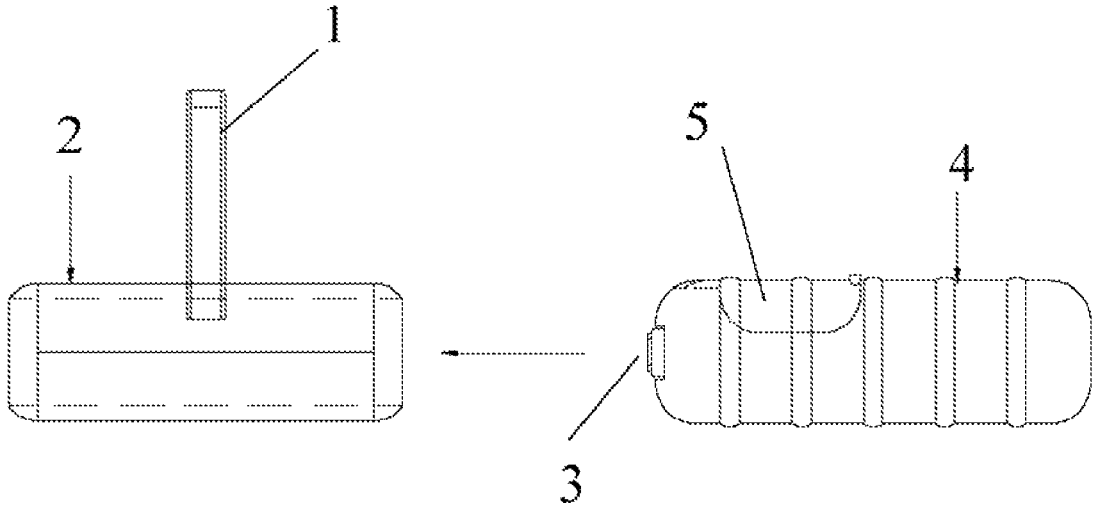
FIG. 11 is an isomeric side expanded view of the vibration barrel that is inserted into the sleeve of the apparatus of the present invention.
Figure 12:
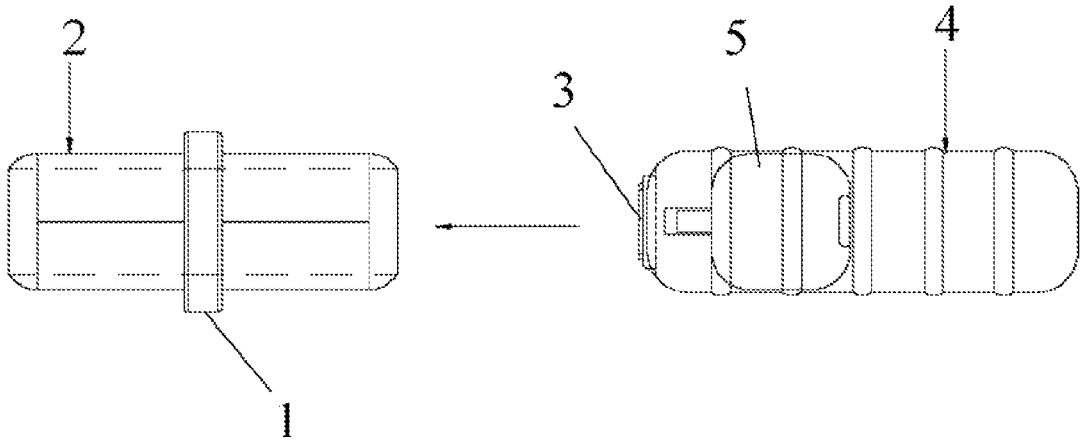
FIG. 12 is an isomeric top expanded view of the vibration barrel that is inserted into the sleeve of the apparatus of the present invention.
Figure 13:
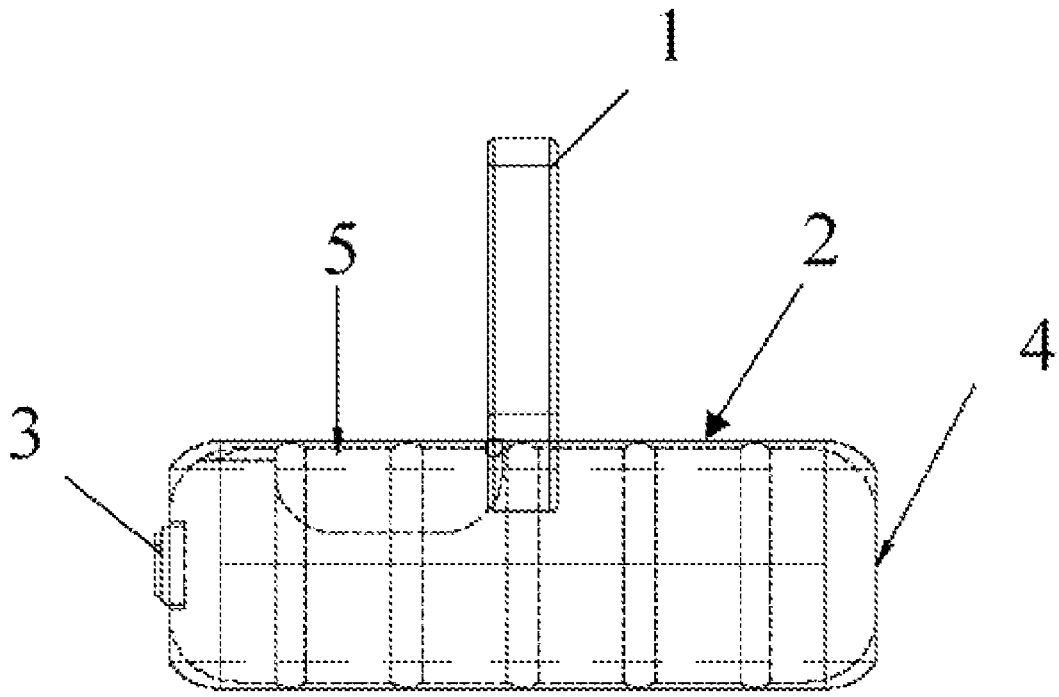
FIG. 13 is an isomeric side view of the sleeve of the apparatus of the present invention with the vibration barrel inserted in to the sleeve.
Figure 14:
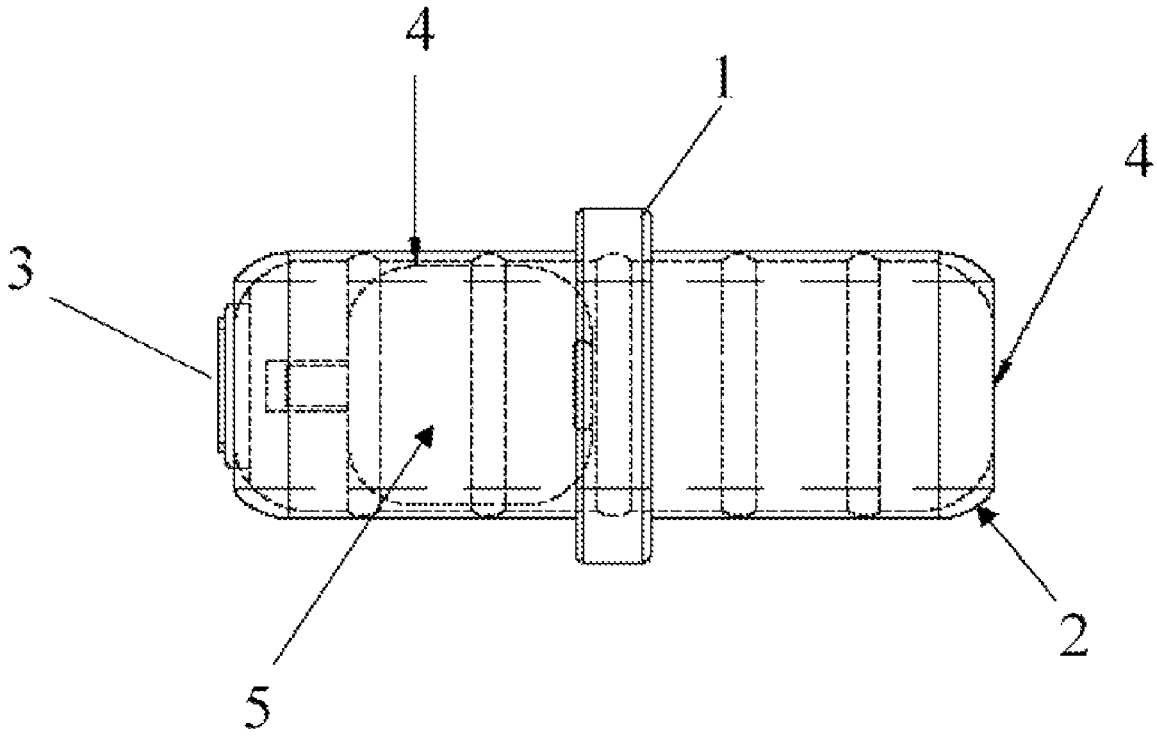
FIG. 14 is an isomeric top view of the sleeve of the apparatus of the present invention with the vibration barrel i inserted in to the sleeve.

Now referring to FIGS. 1, 2, and 3, the elastomeric band 6 is the basis for the invention presented herein. The elastomeric band 6 depicted in the aforementioned figures consists of two parts; the first part is a vibrator barrel case 2 which holds in place a vibrator barrel 4 as illustrated in FIGS. 11, 12, and 13 while the outer sleeve ring 1 of the elastomeric band 6 is designed to wrap around the tongue when the vibrator is in use.

The apparatus comes in two forms, a reusable and a disposable version. The primary distinction is the use of a latch battery door 5 as illustrated in FIGS. 4, 6, 7, and 10 for battery replacement, thereby increasing the useful life of the apparatus dramatically as the battery cells are small and generally have a useful life of approximately thirty minutes.

In one embodiment, the vibration apparatus makes use of two battery cells 10 and 11 within the vibrator barrel 4 which can enhance the power of the apparatus by increasing the revolutions per minute of the small vibrator when the second cell is engaged from 11,000 RPM to 16,000 RPM and as a result a turbo charger no longer needed. Although a turbo charger vibrates much faster than the device of the present invention, even when running on two disposable batteries, the necessity or desire for a turbo charged version is greatly or significantly reduced. Additionally, such turbo charged devices such as the TongueJoy, typically retail for greater than $50 and in most cases $69.95, far greater than the anticipate retail price of the present invention.

In a two-cell version, the apparatus makes use of an on/off vibration switch 3 as illustrated in FIGS. 4, 5, 6, 7, and 8 which is used to determine the speed at which the vibrator will ultimately spin. In an alternative embodiment, the latch door 5 is not used at all and as a result the apparatus will last only as long as the battery cells are able to power the apparatus; this embodiment is known as the disposable version of the tongue ring.

Figure 15:
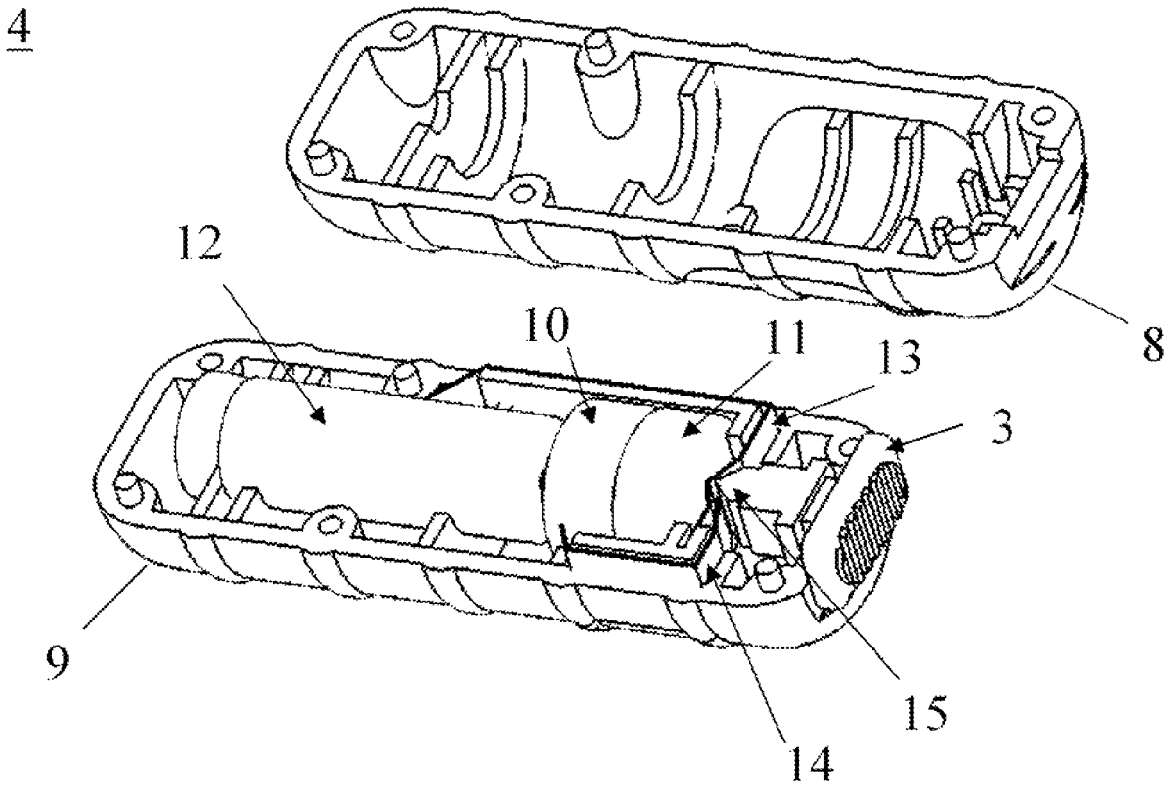
FIG. 15 is a view of the first and second parts of the vibration barrel illustrating the layout of the inner components of the vibration barrel in an off position.
Figure 16:
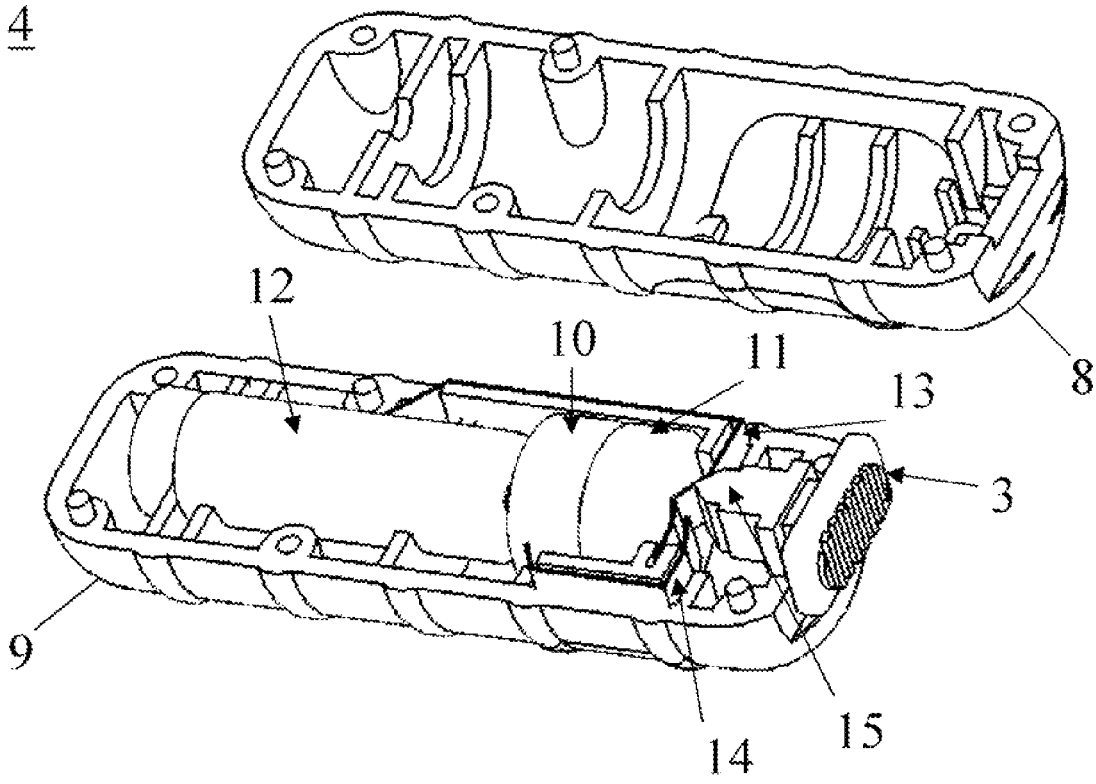
FIG. 16 is a view of the first and second parts of the vibration barrel illustrating the layout of the inner components of the vibration barrel in a single speed position.
Figure 17:
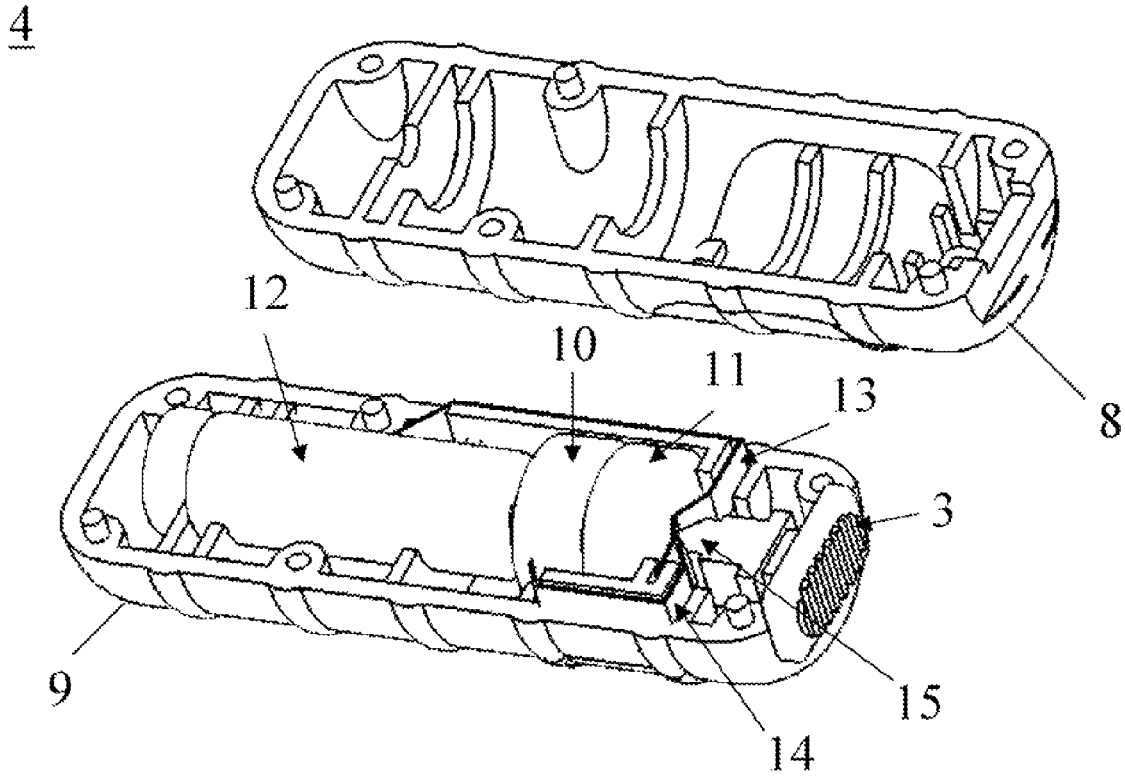
FIG. 17 is a view of the first and second parts of the vibration barrel illustrating the layout of the inner components of the vibration barrel in a dual speed position.

A key aspect of the present invention is the multiple metal pieces that enable the switching mechanism 3 as shown in FIGS. 15, 16 and 17 to engage either a first or second battery when in operation. The metal pieces are used to enable the vibrator motor 2 to run on one or two batteries 10 and 11.

Now referring to FIG. 15, in an off position, a protrusion 15 on the exterior switch 3 enclosed within the vibration barrel 4 is in a fixed position and does not engage the first metal strip 13 or a second metal strip 14. In a first on position as illustrated in FIG. 16, the exterior switch 3 is moved to a first on position, the protrusion 15 on the exterior switch 3 contacts a first metal piece 13 which causes current to flow from a second battery 11 to the vibration motor 12 resulting in the vibration of the apparatus under the power of one battery.

Now referring to FIG. 17, when the exterior switch 3 is moved to a second on position, the protrusion 15 on the exterior switch 3 contacts a first metal piece 13 that causes current to flow from a second battery 11 to the vibration motor 12 and a second metal piece 14 that causes current to flow from a first battery 10 to the vibration motor 12 resulting in the vibration of the apparatus under the power of two batteries.

In an alternative embodiment, the apparatus can be made in a disposable form omitting the latch door 5 and not offering the consumer the ability for battery interchange. In those cases the apparatus will only last as long as the useful life of the batteries 10 and 11 place inside the vibration barrel 4 at the time of manufacture.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. An apparatus comprising:
- a vibration barrel comprising:
  - a vibration motor;
  - a power source for the vibration motor;
- an exterior elastomeric band consisting of
  - a vibration barrel case that houses the vibrator barrel within the vibration barrel case; and
  - a flat loop;
- wherein the longitudinal axis of the flat loop and the longitudinal axis of the vibration barrel case retaining the vibration barrel are parallel and spaced apart;
- the vibration barrel is further comprised of a plurality of battery cells;
- a switching means for engaging only one battery cell for lower rates of vibration and engaging two battery cells for higher rates of vibration;
- the switching means further comprises a protrusion for:
  - contacting a first metal strip that causes current to flow from a first battery to the vibration motor resulting in the vibration of the apparatus under the power of one battery; and
  - contacting a second metal piece that causes current to flow from a first battery to the vibration motor and from a second battery to the vibration motor resulting in the vibration of the apparatus under the power of two batteries.

2. The apparatus of claim 1 further comprising means to regulate the rate of vibration by drawing lower battery power for lower rates of vibration and higher battery power for higher rates of vibration.

3. The apparatus of claim 1 wherein the vibration barrel is further comprised of a latch door for battery interchange.

4. The apparatus of claim 2 wherein the vibration barrel is further comprised of a vibration barrel with a-latch door for battery interchange.

* * * * *